US010960561B2

(12) United States Patent
Kim

(10) Patent No.: US 10,960,561 B2
(45) Date of Patent: Mar. 30, 2021

(54) RAZOR ASSEMBLY WITH SPRING-BIASED CONNECTING HEAD

(71) Applicant: DORCO CO., LTD., Seoul (KR)

(72) Inventor: Dongil Kim, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/191,187

(22) Filed: Nov. 14, 2018

(65) Prior Publication Data

US 2019/0152077 A1 May 23, 2019

(30) Foreign Application Priority Data

Nov. 21, 2017 (KR) ..... 10-2017-0155830

(51) Int. Cl.
*B26B 21/52* (2006.01)
*B26B 21/22* (2006.01)
*B26B 21/40* (2006.01)

(52) U.S. Cl.
CPC ..... *B26B 21/521* (2013.01); *B26B 21/225* (2013.01); *B26B 21/4012* (2013.01)

(58) Field of Classification Search
CPC ... B26B 21/225; B26B 21/521; B26B 21/528; B26B 21/08; B26B 21/10; B26B 21/14; B26B 21/16; B26B 21/165; B26B 21/251; B26B 21/4075
USPC ..... 30/527, 526
See application file for complete search history.

(56) References Cited

U.S. PATENT DOCUMENTS 5,029,391 A 7/1991 Althaus et al.
5,687,485 A 11/1997 Shurtleff et al.
5,761,814 A 6/1998 Anderson et al.
5,953,824 A * 9/1999 Ferraro ..... B26B 21/225 30/527
5,956,848 A 9/1999 Tseng et al.
5,956,851 A 9/1999 Apprille et al.
(Continued)

FOREIGN PATENT DOCUMENTS

EP 0885697 12/1998
JP 04022389 1/1992
(Continued)

OTHER PUBLICATIONS

European Patent Office Application Serial No. 18207490.6, Partial Search Report dated Feb. 1, 2019, 12 pages.
(Continued)

*Primary Examiner* — Jason Daniel Prone
*Assistant Examiner* — Samuel A Davies
(74) *Attorney, Agent, or Firm* — Lee, Hong, Degerman, Kang & Waimey

(57) ABSTRACT

A razor assembly includes at least one razor blade having a cutting edge, a blade housing configured to accommodate the at least one razor blade aligned along first direction, a connecting head configured to be detachably coupled to the blade housing, a razor handle configured to support the connecting head so that the connecting head is pivotable about a rotation axis, which is perpendicular to the first direction, and a torsion spring configured to be elastically deformed when the connecting head pivots about the rotation axis from a neutral position so that the torsion spring provides a restoring force for the connecting head to return to the neutral position.

13 Claims, 24 Drawing Sheets

(56) References Cited

U.S. PATENT DOCUMENTS

| | | | | |
|---|---|---|---|---|
| 6,041,926 | A | 3/2000 | Petricca et al. | |
| 6,052,903 | A | 4/2000 | Metcalf et al. | |
| 6,115,924 | A * | 9/2000 | Oldroyd | B26B 21/521 30/526 |
| 6,185,822 | B1 | 2/2001 | Tseng et al. | |
| 6,212,777 | B1 | 4/2001 | Gilder et al. | |
| 6,301,786 | B1 * | 10/2001 | Oswald | B26B 19/048 30/43.92 |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,745,882 | B2 * | 6/2014 | Murgida | B26B 21/521 30/527 |
| 8,938,885 | B2 | 1/2015 | Stevens | |
| 2004/0181953 | A1 * | 9/2004 | Follo | B26B 21/225 30/527 |
| 2009/0313837 | A1 * | 12/2009 | Winter | B26B 21/521 30/527 |
| 2012/0060382 | A1 * | 3/2012 | Beugels | B26B 19/048 30/527 |
| 2013/0291391 | A1 | 11/2013 | Stevens | |
| 2014/0259679 | A1 * | 9/2014 | Tracy | B26B 21/521 30/50 |
| 2017/0209174 | A1 * | 7/2017 | Khubani | A61B 17/54 |
| 2017/0282392 | A1 | 10/2017 | Maimone et al. | |
| 2019/0152079 | A1 * | 5/2019 | Chang | B26B 21/225 |

FOREIGN PATENT DOCUMENTS

| | | |
|---|---|---|
| JP | 11300065 | 11/1999 |
| JP | 2000300871 | 10/2000 |
| KR | 1020060122880 | 11/2006 |
| WO | 2004076136 | 9/2004 |
| WO | 2005053917 | 6/2005 |

OTHER PUBLICATIONS

Korean Intellectual Property Office Application No. 10-2017-0155830, Search Report dated Nov. 28 2017, 10 pages.

Korean Intellectual Property Office Application No. 10-2017-0155830, Office Action dated Jan. 22, 2018, 40 pages.

Korean Intellectual Property Office Application No. 10-2017-0155830, Notice of Allowance dated Jun. 25, 2018, 2 pages.

* cited by examiner

RAZOR ASSEMBLY WITH SPRING-BIASED CONNECTING HEAD

Pursuant to 35 U.S.C. § 119(a), this application claims the benefit of earlier filing date and right of priority to Korean Patent Application No. 10-2017-0155830, filed on Nov. 21, 2017, the contents of which are all hereby incorporated by reference herein in its entirety.

BACKGROUND

1. Field of the Disclosure

The present disclosure relates to a razor assembly, and more particularly, to a razor assembly which is pivotable about a rotation axis which is perpendicular to a direction in which razor blades are aligned.

2. Description of the Related Art

Generally, a conventional razor assembly, which is known as a wet razor, includes a razor cartridge and a razor handle. Generally, the razor cartridge includes at least one blade disposed between a rear side of a guard bar and a front side of a cap. The razor cartridge is installed to be pivotable on the razor handle so that the razor cartridge is able to pivot, with respect to the razor handle, between a neutral position and a pivot position during use of the razor assembly. Such pivoting motion is fundamentally performed about a rotation axis that is parallel to a direction in which the razor blade is disposed on the razor cartridge.

Therefore, when the razor cartridge is completely rotated to be in a direction of a cutting surface, the razor cartridge is at the neutral position. The pivoting movement of the razor cartridge between the neutral position and the pivot position with respect to the razor handle plays an important role since such pivoting movement enables the razor cartridge and blades related thereto to remain in contact with the cutting surface.

During general shaving, the razor cartridge tends to pivot toward the pivot position with respect to the razor handle as the razor cartridge becomes more distant from the cutting surface due to a predetermined force. The force mainly includes a frictional force which is caused due to the cutting surface passing through the guard bar and a force required when the blades cut hair. To compensate for the characteristic of the razor cartridge pivoting as becoming more distant from the cutting surface, the razor usually uses a bias member such as a spring plunger. The bias member applies a force toward the neutral position to the razor cartridge and serves to keep the razor cartridge in contact with the cutting surface.

In this way, the function in which a razor cartridge is pivotable about an axis which is parallel to a direction in which razor blades are aligned is very commonly provided even by conventional razors. In recent years, a multiaxial pivoting razor to which, in addition to such a pivoting function, a function in which the razor cartridge pivots about other axes, which are perpendicular to the axis, is added so that the razor blades are allowed to more smoothly come into contact with various profiles of a user's skin has also been developed.

However, a case in which a structure of a razor becomes complicated to provide various movements of such a multiaxial pivoting razor or a pivoting movement is not properly provided due to a structural weakness may occur. Therefore, it is required to develop a razor assembly having a new configuration that is capable of stably providing pivoting movements about other axes, which are perpendicular to an axis which is parallel to a direction in which razor blades are aligned, even with a simpler structure.

SUMMARY

Aspects of the present disclosure provide a razor assembly that surely and stably provides a pivoting movement about a rotation axis which is perpendicular to an axis which is parallel to a direction in which razor blades are aligned.

Aspects of the present disclosure also provide a razor assembly that provides the pivoting movement about the rotation axis with a simpler structure and is not deformed even after being used for a long period of time.

Aspects of the present disclosure also provide the pivoting movement about the rotation axis through torsional deformation or extensional deformation of an elastic member itself.

It should be noted that objects of the present disclosure are not limited to the above-mentioned objects, and other unmentioned objects of the present disclosure will be apparent to those skilled in the art from the following descriptions.

To achieve the above objects, a razor assembly according to an embodiment of the present disclosure includes at least one razor blade having a cutting edge, a blade housing configured to accommodate the at least one razor blade in a transverse direction, a connecting head configured to be detachably coupled to the blade housing, a razor handle configured to support the connecting head so that the connecting head is pivotable about a rotation axis, which is perpendicular to the transverse direction, and a torsion spring configured to be elastically deformed when the connecting head pivots about the rotation axis from a neutral position so that the torsion spring provides a restoring force for the connecting head to return to the neutral position, wherein the rotation axis is perpendicular to both the transverse direction and a longitudinal direction in which the razor handle extends, and a central axis of the torsion spring coincides with the rotation axis.

To achieve the above objects, a razor assembly according to another embodiment of the present disclosure includes at least one razor blade having a cutting edge, a blade housing configured to accommodate the at least one razor blade in a transverse direction, a connecting head configured to be detachably coupled to the blade housing, a razor handle configured to support the connecting head so that the connecting head is pivotable about a rotation axis, which is perpendicular to the transverse direction, and a torsion spring configured to be elastically deformed when the connecting head pivots about the rotation axis from a neutral position so that the torsion spring provides a restoring force for the connecting head to return to the neutral position, wherein the rotation axis is parallel to a longitudinal direction in which the razor handle extends, and a central axis of the torsion spring coincides with the rotation axis.

To achieve the above objects, a razor assembly according to still another embodiment of the present disclosure includes at least one razor blade having a cutting edge, a blade housing configured to accommodate the at least one razor blade in a transverse direction, a connecting head configured to be detachably coupled to the blade housing, a razor handle configured to support the connecting head so that the connecting head is pivotable about a rotation axis, which is perpendicular to the transverse direction, and a coil spring configured to be elastically deformed when the connecting head pivots about the rotation axis from a neutral position so that the coil spring provides a restoring force for the connecting head to return to the neutral position, wherein the rotation axis is in a direction that is perpendicular to both the transverse direction and a longitudinal direction in which the razor handle extends, one end of the coil spring is locked to a first fixing end formed at the connecting head, and the other end of the coil spring is locked to a second fixing end formed at the razor handle.

BRIEF DESCRIPTION OF THE DRAWINGS

The above and other aspects and features of the present disclosure will become more apparent by describing exemplary embodiments thereof in detail with reference to the attached drawings, in which.

DETAILED DESCRIPTION OF THE EMBODIMENTS

Figure 1A:
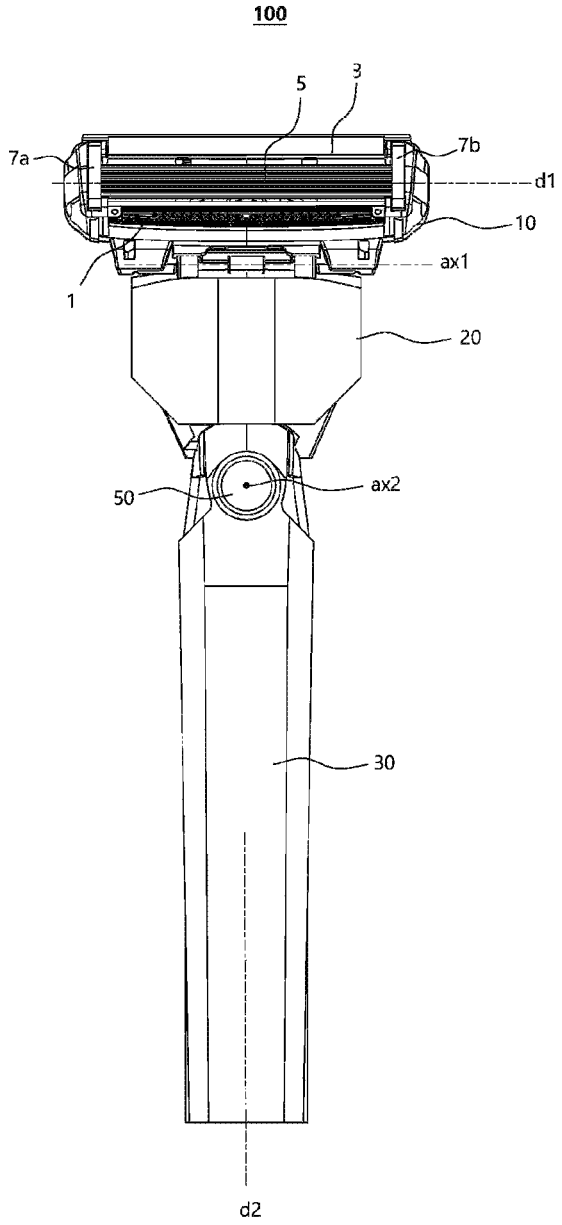
FIG. 1A is a plan view of a razor assembly according to a first embodiment of the present disclosure that is seen from the front of a razor handle.

Advantages and features of the present disclosure and a method of achieving the same should become clear with embodiments described in detail below with reference to the accompanying drawings. However, the present disclosure is not limited to the embodiments disclosed below and may be realized in various other forms. The present embodiments make the disclosure complete and are provided to completely inform one of ordinary skill in the art to which the present disclosure pertains of the scope of the disclosure. The present disclosure is defined only by the scope of the claims. Like reference numerals refer to like elements throughout.

Unless otherwise defined, all terms including technical and scientific terms used herein have the same meaning as commonly understood by one of ordinary skill in the art to which the present disclosure pertains. Terms, such as those defined in commonly used dictionaries, are not to be construed in an idealized or overly formal sense unless expressly so defined herein.

Terms used herein are for describing the embodiments and are not intended to limit the present disclosure. In the present specification, a singular expression includes a plural expression unless the context clearly indicates otherwise. "Comprises" and/or "comprising" used herein do not preclude the existence or the possibility of adding one or more elements other than those mentioned.

Hereinafter, an embodiment of the present disclosure will be described in detail with reference to the accompanying drawings.

Figure 1B:
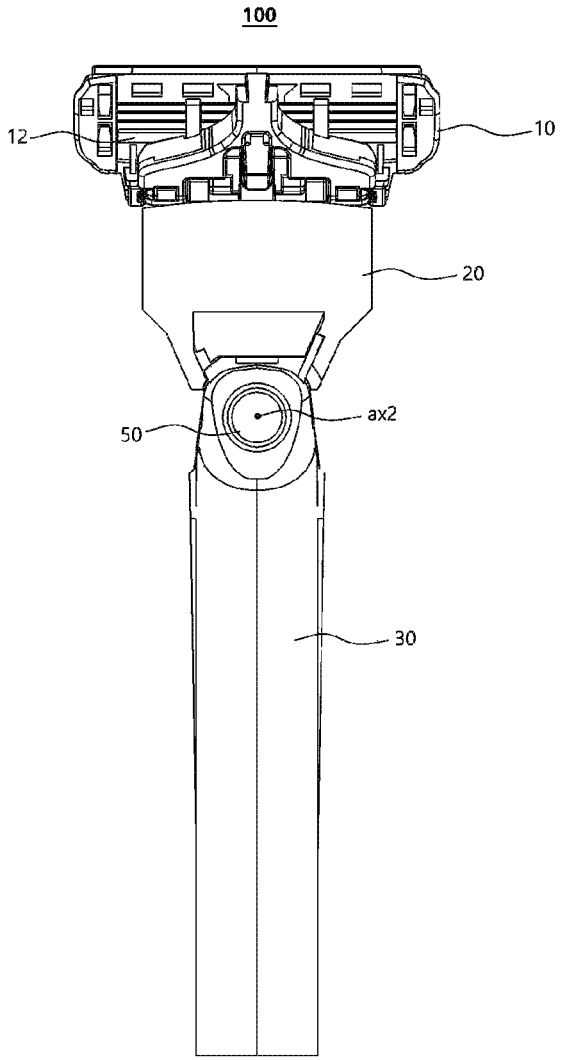
FIG. 1B is a rear view thereof seen from the rear of the razor handle.
Figure 1C:
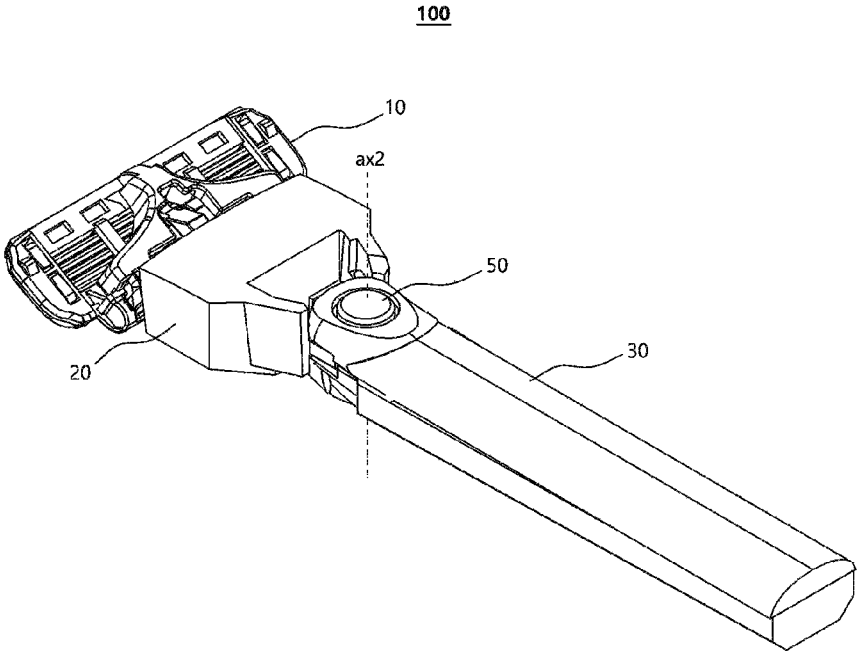
FIG. 1C is a perspective view thereof seen from one side of the rear of the razor handle.

FIG. 1A is a plan view of a razor assembly 100 according to a first embodiment of the present disclosure that is seen from the front of a razor handle 30 (from a side at which a front surface of a blade housing 10 is visible), FIG. 1B is a rear view thereof seen from the rear of the razor handle 30, and FIG. 1C is a perspective view thereof seen from one side of the rear of the razor handle 30.

The razor assembly 100 according to the first embodiment of the present disclosure may include a razor cartridge including a razor blade 5 and the blade housing 10, a connecting head 20, and the razor handle 30. One end of the razor blade 5 includes a cutting edge, and the other end thereof is seated on a seating portion included in the blade housing 10. In this case, a single razor blade 5 or two or more razor blades 5 may be disposed, and a direction in which the razor blade 5 is accommodated in the blade housing 10 is a transverse direction d1 that is perpendicular to a shaving direction.

In order to prevent detachment of the razor blade 5 from the blade housing 10, a pair of clips 7*a* and 7*b* configured to fix both sides of the one end of the razor blade 5 to the blade housing 10 may be included. The pair of clips 7*a* and 7*b*, which surround the both sides of the razor blade 5, pass through at least one through-hole formed in the vicinity of both side ends of the blade housing 10 and are bent at a rear surface 12 of the blade housing 10.

In addition, a guard bar 1 may be disposed in a direction parallel to the razor blade 5 in front of a position at which the razor blade 5 is seated on the blade housing 10, and a lubrication band 3 may be disposed in the direction parallel to the razor blade 5 behind the position. The guard bar 1 causes facial hair of a user to stand upright in a direction that is perpendicular to a shaving direction so that cutting facial hair by the razor blade 5 is facilitated, and the lubrication band 3 serves to soothe irritated skin after the cutting.

In FIG. 1A, the connecting head 20 is detachably coupled to the blade housing 10 at the rear surface 12 of the blade housing 10. In this case, the blade housing 10 may pivot about a first axis ax1, which is parallel to the transverse direction d1 in which the razor blade 5 is accommodated, with respect to an end of the connecting head.

Meanwhile, the connecting head 20 is also coupled with the razor handle 30 so that the connecting head 20 is pivotable about a rotation axis ax2, which is perpendicular to the transverse direction d1. The rotation axis, i.e., the second axis ax2, is formed in a direction that is perpendicular to both the transverse direction d1 and a longitudinal direction d2 of the razor handle 30. Such coupling is performed by an engaging tool 50 that passes through both the connecting head 20 and the razor handle 30 at a position of the second axis ax2. The engaging tool 50 may be implemented using a fixing pin, but is not limited thereto. The engaging tool 50 encompasses shaft-like members that enable pivoting between the connecting head 20 and the razor handle 30.

Figure 2A:
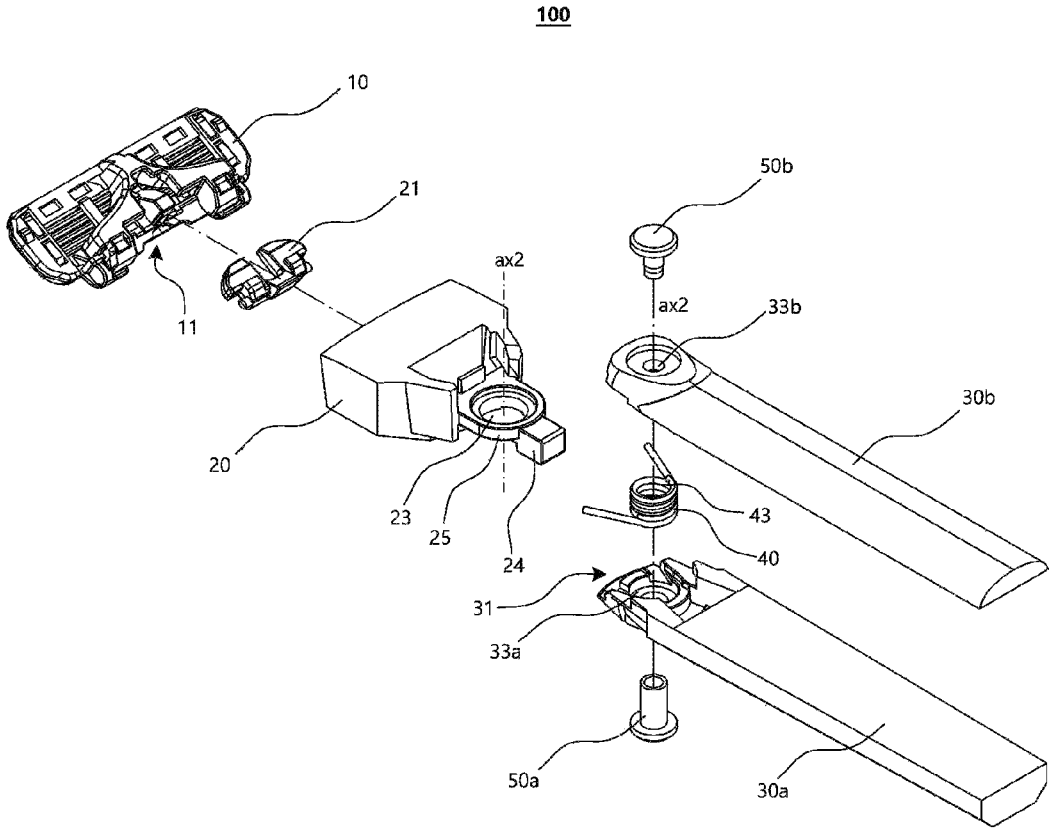
FIGS. 2A and 2B are exploded perspective views of the razor assembly of FIG. 1A seen in different directions.
Figure 2B:
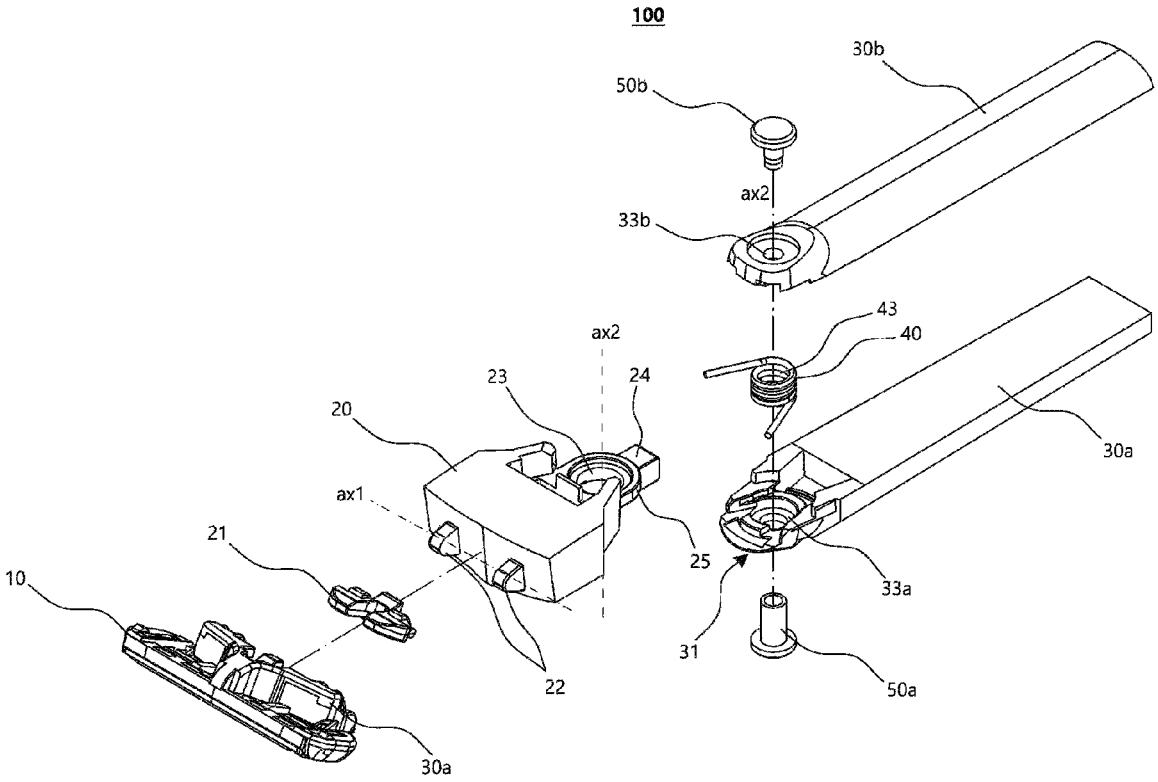

FIGS. 2A and 2B are exploded perspective views of the razor assembly 100 of FIG. 1A seen in different directions. Referring to FIGS. 2A and 2B, a plunger guard 21 is pivotably coupled to a protrusion 22 disposed at a front end side of the connecting head 20. Therefore, the plunger guard 21 is pivotable about the first axis ax1 within a predetermined angle range. In addition, by being inserted into a coupling space 11 formed at the rear surface of the blade housing 10, the plunger guard 21 may be engaged with the blade housing 10. Therefore, ultimately, the blade housing 10 becomes pivotable about the first axis ax1 within the predetermined angle range.

Meanwhile, at an opposite side of the plunger guard 21, the connecting head 20 is pivotably coupled to the razor handle 30 using engaging tools 50*a* and 50*b*. For example, the razor handle 30 may be formed of two accommodating members 30*a* and 30*b* which are divided from each other in the longitudinal direction. The accommodating members 30*a* and 30*b* provide an accommodating space 31 for accommodating a pivot member 25 and a torsion spring 40 of the connecting head 20. At the position of the second axis ax2, the engaging tools 50*a* and 50*b* may be coupled to each other by passing through all of a through-hole 33*a* of the first accommodating member 30*a*, a through-hole 23 of the pivot member 25, a hollow 43 of the torsion spring 40, and a through-hole 33*b* of the second accommodating member 30*b*. Therefore, a direction of a central axis of the torsion spring 40, i.e., a direction that the hollow 43 faces, coincides with the second axis.

Figure 3:
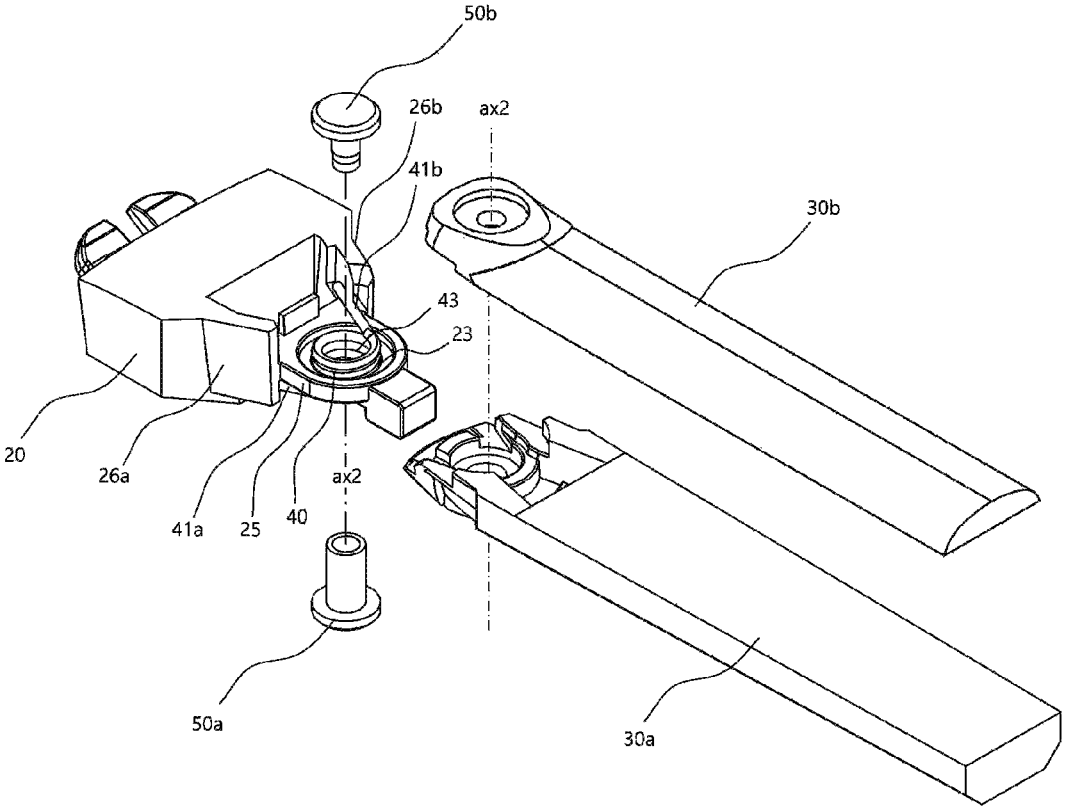
FIG. 3 is a perspective view showing the shape of the razor assembly after a torsion spring is mounted on a connecting head and before the razor assembly is mounted on a razor handle.

FIG. 3 is a perspective view showing the shape of the razor assembly 100 after the torsion spring 40 is mounted on the connecting head 20 and before the razor assembly 100 is mounted on razor handles 30*a* and 30*b* (a razor cartridge 10 is omitted). When the torsion spring 40 is mounted on the pivot member 25 of the connecting head 20 (particularly, the through-hole 23 of the pivot member 25), one end 41*a* and the other end 41*b* of the torsion spring 40 are supported by inner surfaces of opposite sidewalls 26*a* and 26*b*, respectively, of the connecting head. In this case, for stable operation, the both ends of the torsion spring 40 may be set to be in a state (pre-pressure state) in which the both ends are pressed by the sidewalls 26*a* and 26*b* even when the connecting head 20 is at a neutral position. Of the both ends 41*a* and 41*b* of the torsion spring 40, the one end 41*a* is disposed below the pivot member 25 and the other end 41*b* is disposed above the pivot member 25 in a thickness direction of the connecting head 20 (that is, the ax2 direction). That is, the both ends 41*a* and 41*b* of the torsion spring 40 are disposed at opposite sides from each other with respect to the through-hole 23 of the pivot member 25.

In this way, after the torsion spring 40 is mounted in the connecting head 20, a front surface and a rear surface of the pivot member 25 of the connecting head 20 may be assembled by the first and second accommodating members 30*a* and 30*b*. Then, at the position of the second axis ax2, by engaging the engaging tools 50*a* and 50*b* by passing through the first accommodating member 30*a*, the through-hole 23 of the pivot member 25, the hollow 43 of the torsion spring 40, and the second accommodating member 30*b*, the assembly between the connecting head 20 and the razor handle 30 is completed.

Meanwhile, if the both ends 41*a* and 41*b* of the torsion spring 40 are only installed at the opposite sidewalls 26*a* and 26*b* and in the pivot member 25 of the connecting head 20, it may not be possible to provide a restoring force when the connecting head 20 pivots. Therefore, there is a need for the both ends 41*a* and 41*b* of the torsion spring 40 to be simultaneously supported at one side inside the razor handle 30 as well as the opposite sidewalls 26*a* and 26*b* of the connecting head 20.

Figure 4A:
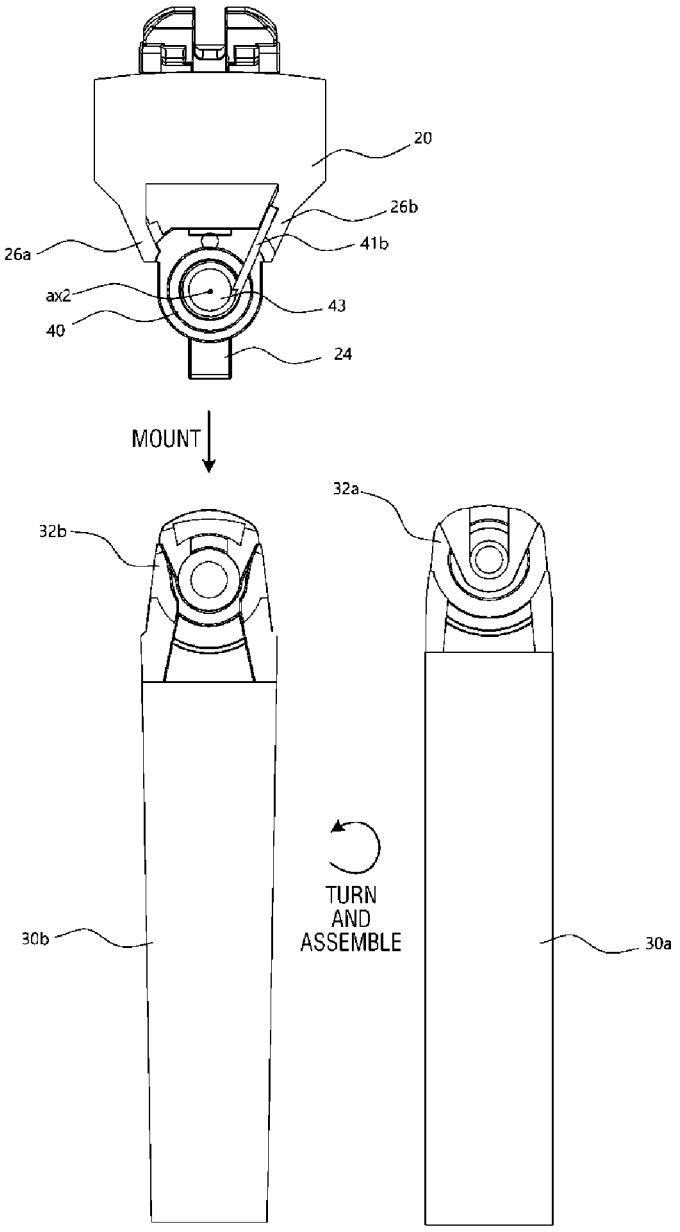
FIG. 4A is a view showing a form in which the connecting head and first and second accommodating members are assembled that is seen from the rear of the razor assembly according to the first embodiment.
Figure 4B:
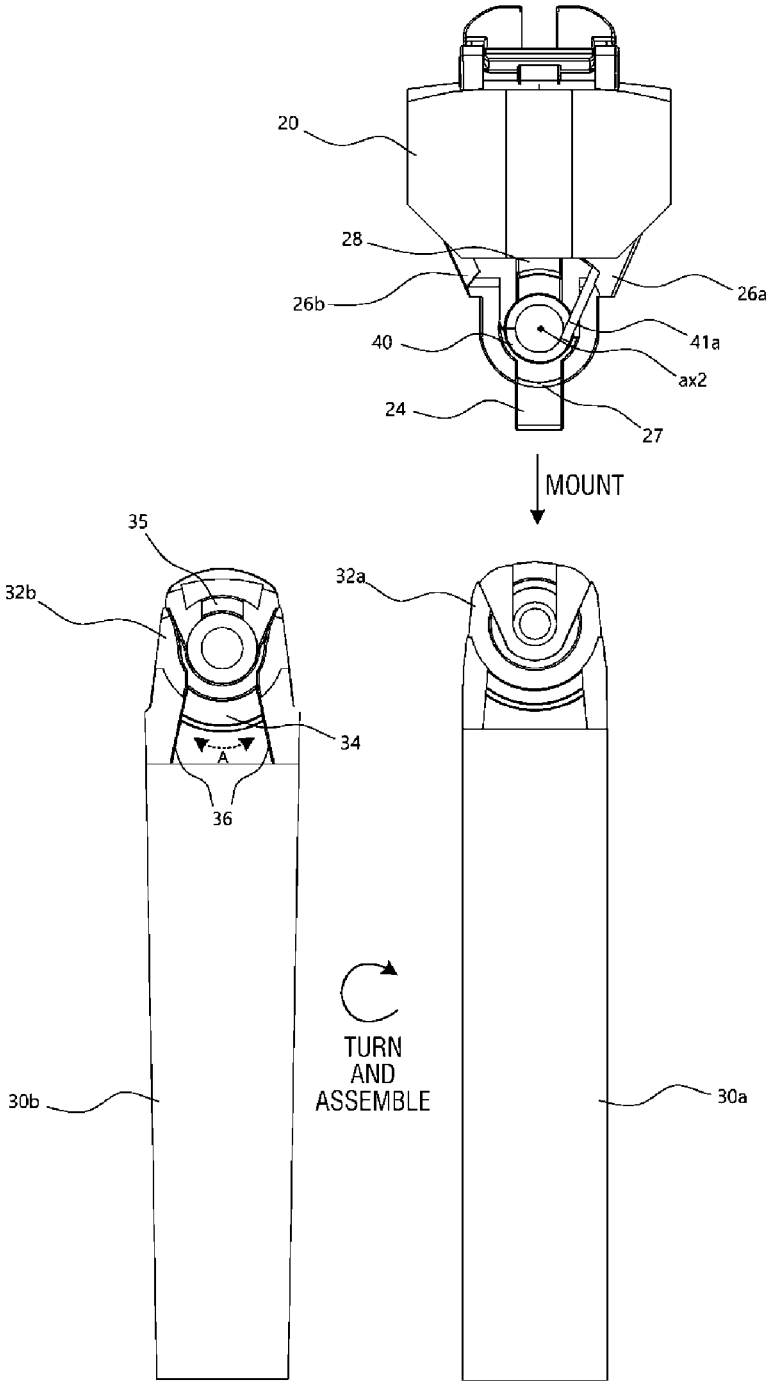
FIG. 4B is a view showing a form in which the connecting head and the first and second accommodating members are assembled that is seen from the front of the razor assembly according to the first embodiment.

FIGS. 4A and 4B are views showing a form in which the connecting head 20 and the first and second accommodating members 30*a* and 30*b* are to be assembled that are seen from the rear and the front, respectively, of the razor assembly 100.

Referring to FIG. 4A, when the connecting head 20 is mounted on the second accommodating member 30*b* at the neutral position, while an externally facing side, or a distal side (a side that is far from the hollow 43 of the torsion spring 40) of the other end 41*b* of the torsion spring 40 is in contact with and supported by the second sidewall 26*b* of the connecting head 20, an internally facing side, or a proximal side (a side that is close to the hollow 43 of the torsion spring 40) of the other end 41*b* of the torsion spring 40 is in contact with and supported by one side of the razor handle 30, more specifically, by a support wall 32*a* of the first accommodating member 30*a*.

Therefore, in FIG. 4A, when the connecting head 20 pivots clockwise with respect to the razor handle 30, the other end 41*b* of the torsion spring 40 is somewhat detached from the second sidewall 26*b* but is still supported by the support wall 32*a* of the first accommodating member 30*a* such that the position of the other end 41*b* substantially does not change. On the other hand, in FIG. 4A, when the connecting head 20 pivots counterclockwise with respect to the razor handle 30, the other end 41*b* of the torsion spring 40 is pressed counterclockwise by the second sidewall 26*b* and is displaced. In this case, the other end 41*b* of the torsion spring 40 is somewhat detached from the support wall 32*a* of the first accommodating member 30*a*.

Likewise, referring to FIG. 4B, when the connecting head 20 is mounted on the first accommodating member 30*a* at the neutral position, while an externally facing, or a distal side of the one end 41*a* of the torsion spring 40 is in contact with and supported by the first sidewall 26*a* of the connecting head 20, an internally facing, or a proximal side of the one end 41*a* of the torsion spring 40 is in contact with and supported by one side of the razor handle 30, more specifically, by a support wall 32*b* of the second accommodating member 30*b*.

Therefore, when the connecting head 20 pivots clockwise with respect to the razor handle 30 based on FIG. 4A, as the one end 41*a* of the torsion spring 40 is pressed clockwise by the first sidewall 26*a* and displaced, the one end 41*a* is somewhat detached from the support wall 32*b* of the second accommodating member 30*b*. In this case, as described above with reference to FIG. 4A, since the other end 41*b* of the torsion spring 40 is not deformed, but the one end 41*a* is deformed toward the side closer to the other end 41*b*, the torsion spring 40 is compressed and the compressive force generates an opposite restoring force of the connecting head 20 counterclockwise about the second axis ax2.

On the other hand, when the connecting head 20 pivots counterclockwise with respect to the razor handle 30 based on FIG. 4A, the one end 41*a* of the torsion spring 40 is detached from the first sidewall 26*a* but is still supported by the support wall 32*b* of the second accommodating member 30*b* such that the position of the one end 41*a* does not change. In this case, as described above with reference to FIG. 4A, since the other end 41*b* of the torsion spring 40 is deformed toward the side closer to the one end 41*a*, the torsion spring 40 is compressed and the compressive force generates an opposite restoring force of the connecting head 20 clockwise about the second axis ax2.

In this way, since the restoring force is generated regardless of a direction in which the connecting head 20 pivots about the second axis ax2 with respect to the razor handle 30, when an external force is removed, the connecting head 20 returns to the neutral position.

In the first embodiment, in order to guarantee firm assembly while guaranteeing accurate pivoting motion of the connecting head 20, a guide block 24 may be disposed at the connecting head 20, particularly, the pivot member 25. Referring to FIG. 4B, such a guide block 24 has, on at least one side, an arc-shaped profile 27 that may match a guider 34 formed in an arc shape in the second accommodating member 30*b*. Of course, such pivoting motion may also be provided using the engaging tool 50 that passes through the second axis ax2, but firmer and a stable pivoting motion may be achieved through matching between the guide block 24 and the guider 34. In the present embodiment, the guide block 24 has been described as matching the guider 34 formed in the second accommodating member 30*b*, but a guider may also be formed in the first accommodating member 30*a*. In addition to such a first guide block 24, a second guide block 28 may be formed at a different arc position from the first guide block 24, and the second guide block 28 may be set to match a second guider 35 of the second accommodating member 30*b*. In this way, by having combinations of a plurality of guide blocks and guiders at different arc positions, a stable pivoting motion may be achieved regardless of a direction in which an external force acts.

In this way, when the guide block 24 matches the guider 34 and performs pivoting motion, the pivoting range is limited to a specific angle A (see FIG. 4B). This is to limit a range of pivoting about the second axis ax2 during shaving to a range that does not cause inconvenience of a user. In the present embodiment, the limiting is performed as opposite surfaces of the guide block 24 come into contact with stopper surfaces 36 at opposite sides when the opposite surfaces of the guide block 24 pivot in a direction A.

Figure 5:
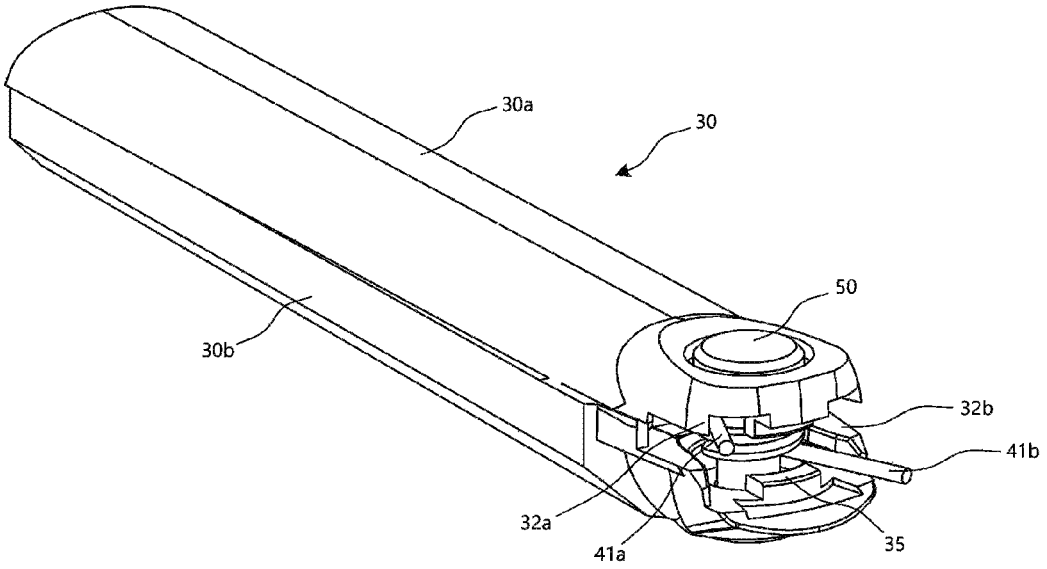
FIG. 5 is a perspective view showing a form in which, while the connecting head is removed, a torsion spring is mounted on the razor handle.

FIG. 5 is a perspective view showing a form in which, while the connecting head 20 is removed, the torsion spring 40 is mounted on the razor handle 30. As can be seen in FIG. 5, the support wall 32*a* of the first accommodating member 30*a* and the support wall 32*b* of the second accommodating member 30*b* serve as rotation preventing structures that prevent idle rotation of the torsion spring 40 in each pivoting direction. In this way, since the both ends 41*a* and 41*b* of the torsion spring 40 are disposed at opposite sides from each other in a thickness direction of the razor handle 30, the both ends 41*a* and 41*b* may be supported by the support walls 32*a* and 32*b* formed at different accommodating members 30*a* and 30*b*.

The razor assembly 100 in which, using a torsion spring, a connecting head is pivotable about the second axis ax2, which is perpendicular to both the direction d1 in which the razor blades are aligned and the longitudinal direction d2 of the razor handle, has been described above in the first embodiment of the present disclosure. Hereinafter, a razor assembly 200 in which, using the torsion spring, the connecting head is pivotable about a third axis ax3, which is parallel to the longitudinal direction d2 of the razor handle, will be described in a second embodiment.

Figure 6A:
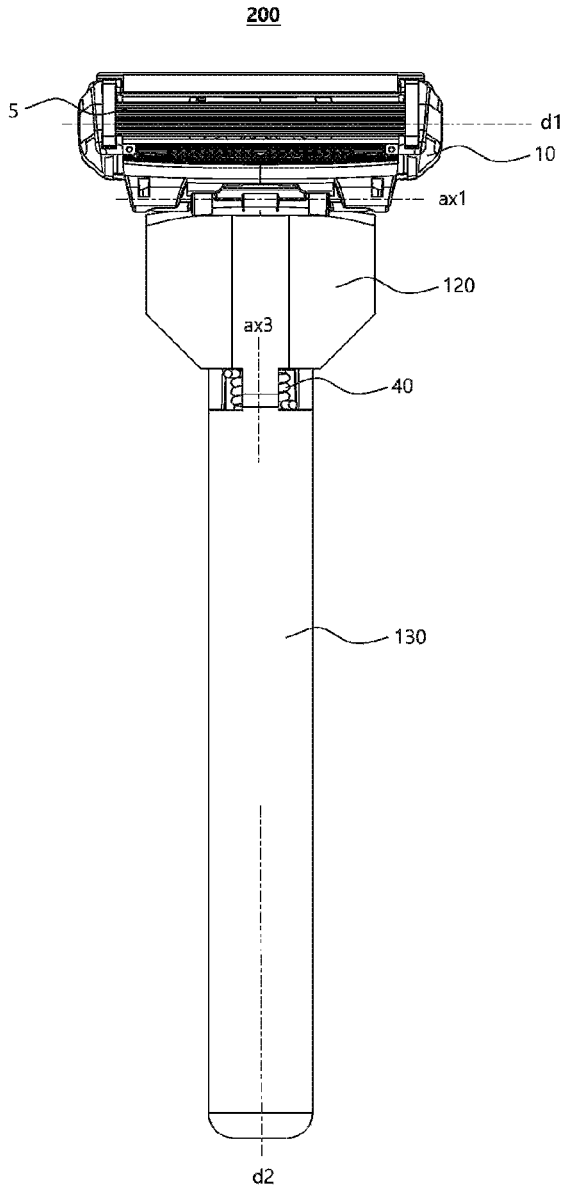
FIG. 6A is a plan view of a razor assembly according to a second embodiment of the present disclosure that is seen from the front of a blade housing.
Figure 6B:
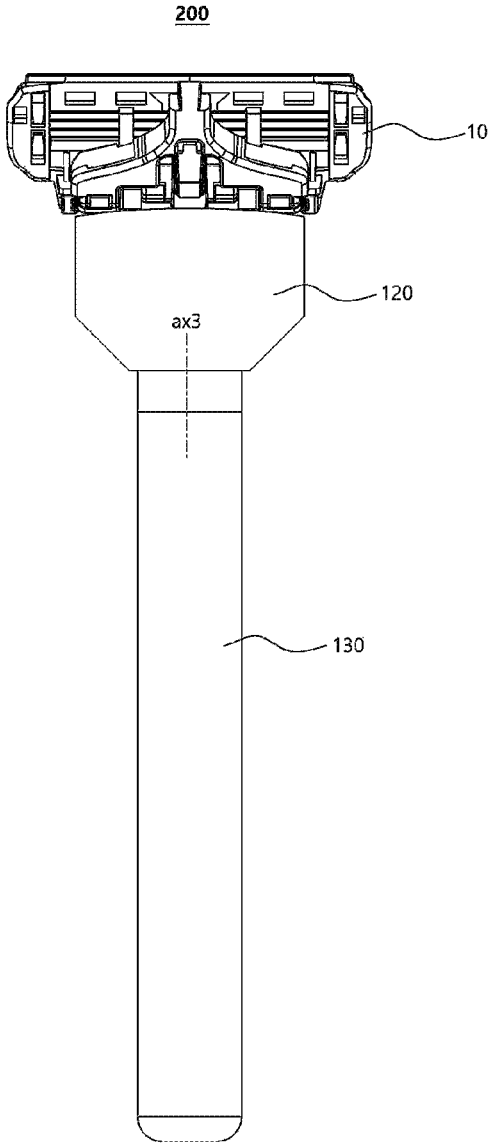
FIG. 6B is a rear view thereof seen from the rear of the blade housing.
Figure 6C:
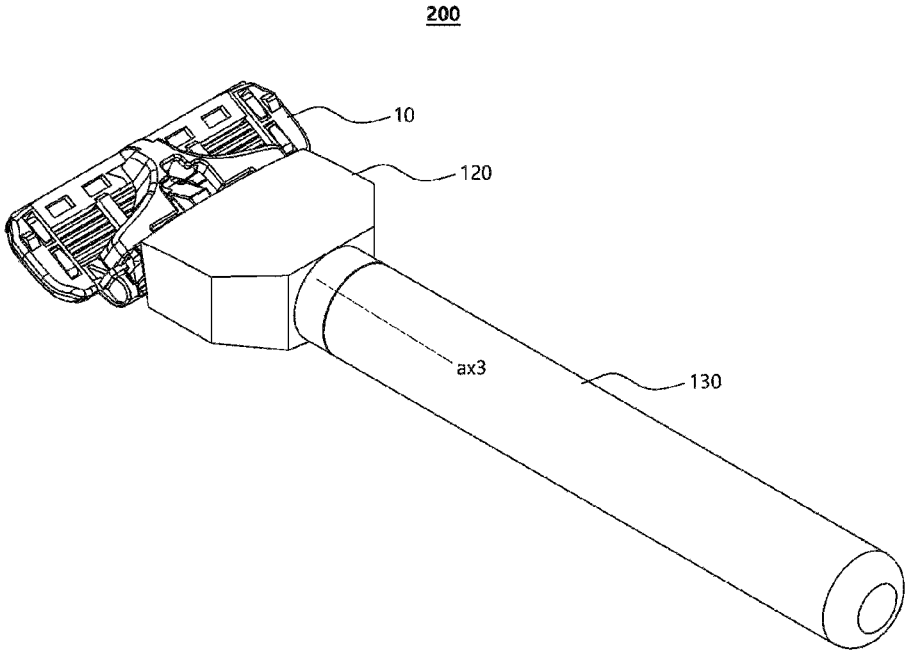
FIG. 6C is a perspective view thereof seen from one side of the rear of the blade housing.

FIG. 6A is a plan view of the razor assembly 200 according to the second embodiment of the present disclosure that is seen from the front of the blade housing 10, FIG. 6B is a rear view thereof seen from the rear of the blade housing 10, and FIG. 6C is a perspective view thereof seen from one side of the rear of the blade housing 10.

The razor assembly 200 according to the second embodiment of the present disclosure may include a razor cartridge including the razor blade 5 and the blade housing 10, a connecting head 120, and a razor handle 130. One end of the razor blade 5 includes a cutting edge, and the other end thereof is seated on a seating portion included in the blade housing 10. In this case, a single razor blade 5 or two or more razor blades 5 may be disposed, and a direction in which the razor blade 5 is accommodated in the blade housing 10 is a transverse direction d1 that is perpendicular to a shaving direction.

In FIG. 6A, the connecting head 120 is detachably coupled to the blade housing 10 at a rear surface of the blade housing 10. In this case, the blade housing 10 may pivot about the first axis ax1, which is parallel to the transverse direction d1 in which the razor blade 5 is accommodated, with respect to an end of the connecting head.

Meanwhile, the connecting head 120 is also coupled with the razor handle 130 so that the connecting head 120 is pivotable about the rotation axis ax3, which is perpendicular to the transverse direction d1. The rotation axis, i.e., the third axis ax3, is formed in a direction that is parallel to the longitudinal direction d2 of the razor handle 130. In this case, the torsion spring 40 is disposed at a connection portion between the connecting head 120 and the razor handle 130, and thus, when the connecting head 120 pivots about the third axis ax3 with respect to the razor handle 130, a restoring force is provided by the torsion spring 40.

Figure 7A:
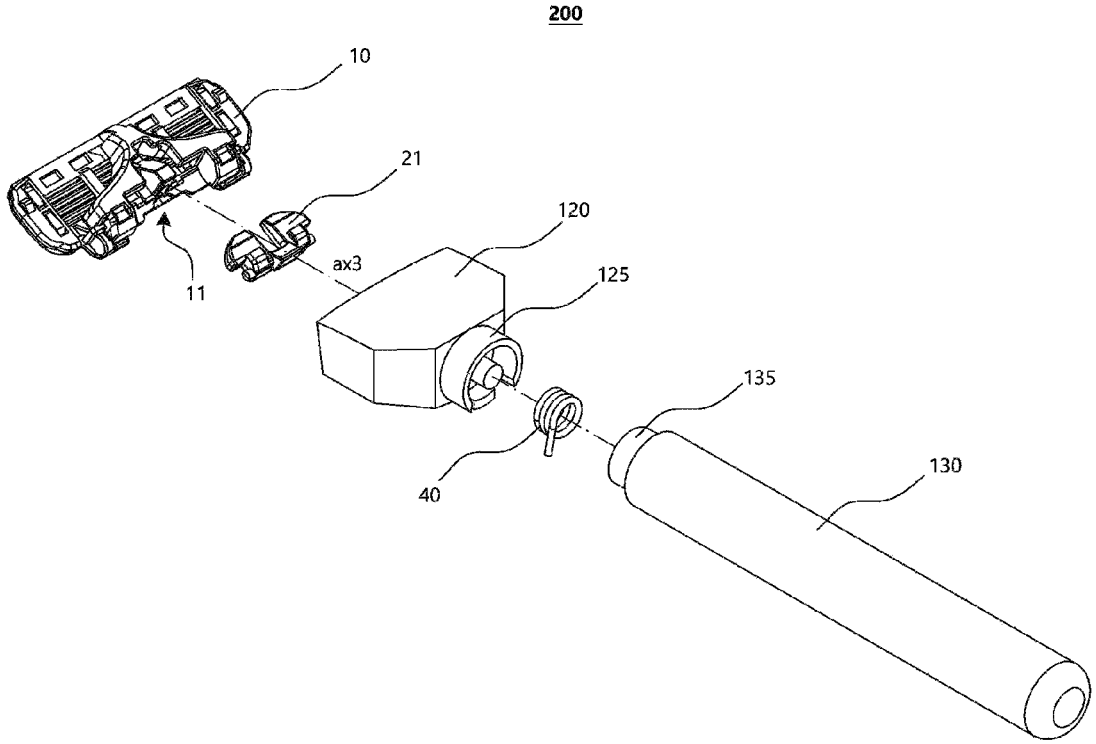
FIGS. 7A and 7B are exploded perspective views of the razor assembly of FIG. 6A seen in different directions.
Figure 7B:
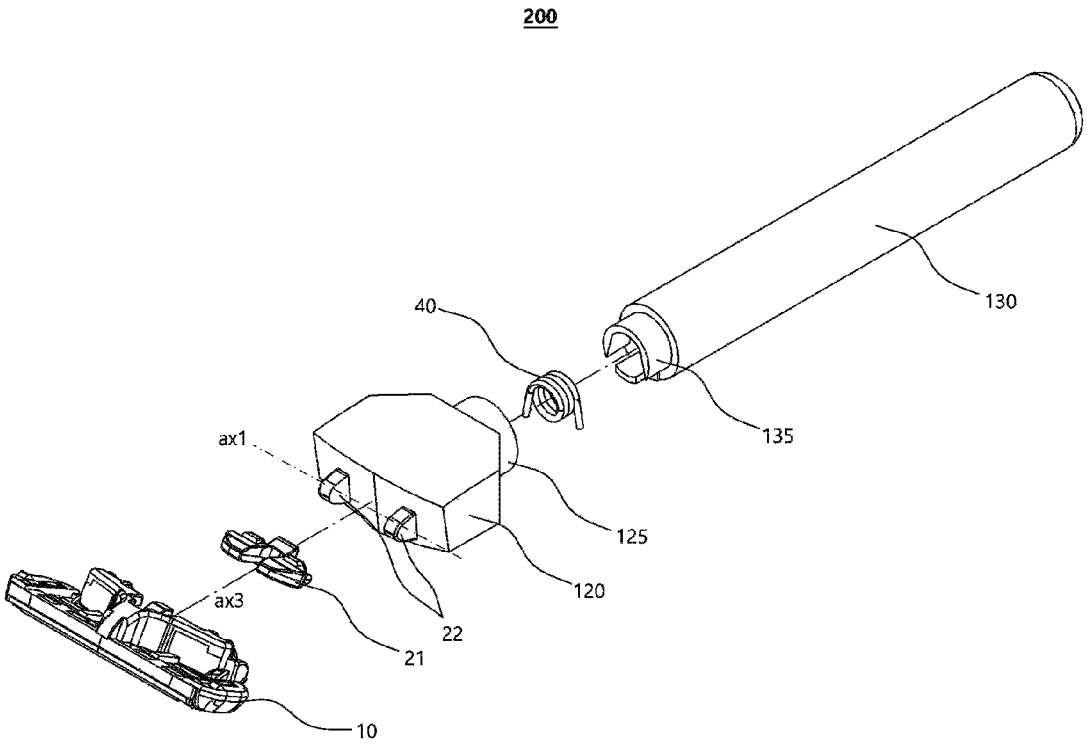

FIGS. 7A and 7B are exploded perspective views of the razor assembly 200 of FIG. 6A seen in different directions. Referring to FIGS. 7A and 7B, the plunger guard 21 is pivotably coupled to the protrusion 22 disposed at a front end side of the connecting head 120. Therefore, the plunger guard 21 is pivotable about the first axis ax1 within a predetermined angle range. In addition, by being inserted into the coupling space 11 formed at the rear surface of the blade housing 10, the plunger guard 21 may be engaged with the blade housing 10. Therefore, ultimately, the blade housing 10 becomes pivotable about the first axis ax1 within the predetermined angle range.

Meanwhile, at an opposite side of the plunger guard 21, a pivot member 125 formed at an end of the connecting head 120 is coupled to a guide member 135 formed at an end of the razor handle 130 so as to be pivotable about the third axis ax3. The torsion spring 40 is disposed in the third axis ax3 direction between the pivot member 125 and the guide member 135 which are coupled. Therefore, a direction of a central axis, i.e., a direction that the hollow 43 faces, of the torsion spring 40, coincides with the third axis.

Figure 8A:
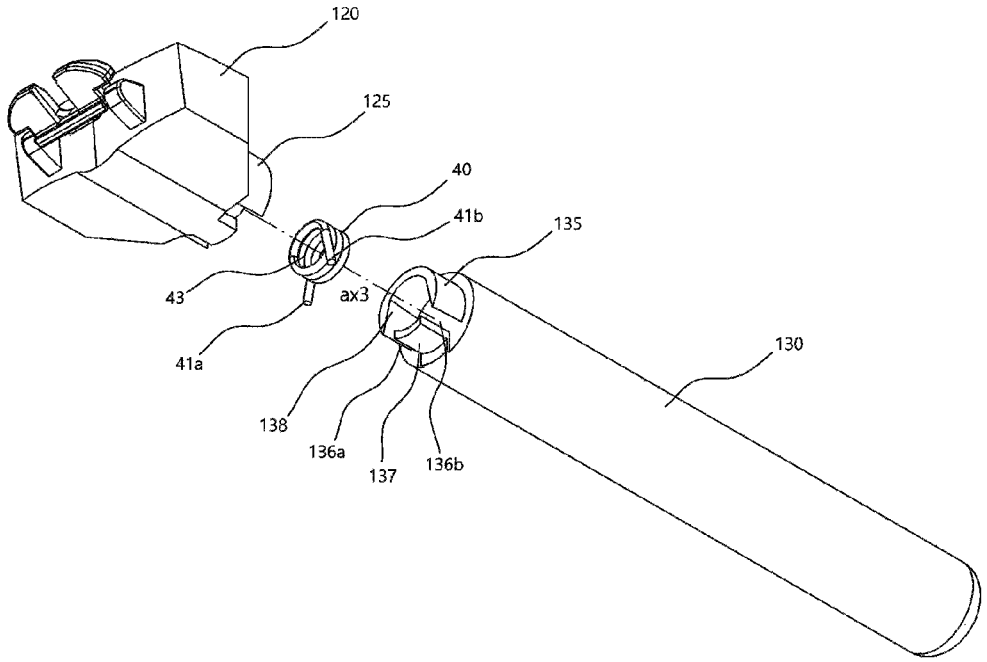
FIGS. 8A and 8B are perspective views seen in different directions to more specifically show a shape right before assembly between the connecting head and the razor handle.
Figure 8B:
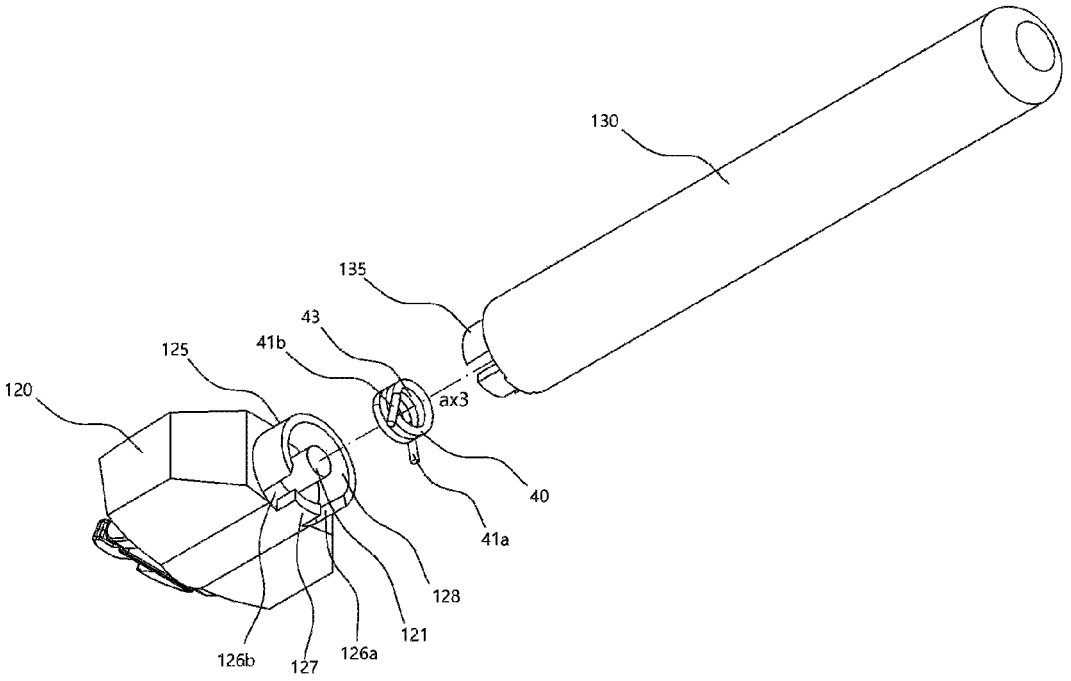

FIGS. 8A and 8B are perspective views seen in different directions to more specifically show a shape before assembly between the connecting head 120 and the razor handle 130. The pivot member 125 of the connecting head 120 and the guide member 135 of the razor handle 130 includes partition walls 127 and 128 and partition walls 137 and 138, respectively, which are formed in a substantially circumferential direction around the third axis ax3 so that a space for accommodating the torsion spring 40 may be secured. Specifically, the pivot member 125 of the connecting head 120 includes a first partition wall 127 and a second partition wall 128, and the guide member 135 of the razor handle 130 includes a third partition wall 137 and a fourth partition wall 138.

The first and second partition walls 127 and 128 are formed to be spaced a first interval apart from each other by slots 126*a* and 126*b* on a first circumference around the third axis ax3. Likewise, the third and fourth partition walls 137 and 138 are formed to be spaced a second interval apart from each other by slots 136*a* and 136*b* on a second circumference around the third axis ax3. In addition, a central shaft 121 which extends toward the razor handle 130 is formed at the center of the pivot member 125 (the center of the first circumference). In the present embodiment, the first circumference is illustrated as being greater than the second circumference and thus the first and second partition walls 127 and 128 of the pivot member 125 surround the third and fourth partition walls 137 and 138 of the guide member 135, but this is merely an example, and the opposite is also possible. In addition, the central shaft 121 may also be disposed at the guide member 135 side.

During assembly between the connecting head 120 and the razor handle 130, the central shaft 121 is inserted into the hollow 43 of the torsion spring 40, and the partition walls 127 and 128 of the pivot member 125 are coupled to surround the partition walls 137 and 138 of the guide member 135. In this case, the slots 126*a* and 126*b* of the pivot member 125 are aligned to match the slots 136*a* and 136*b*, respectively, of the guide member 135, and the both ends 41*a* and 41*b* of the torsion spring 40 are supported by passing through the aligned slots 126*a* and 126*b* and 136*a* and 136*b*, respectively.

Figure 9A:
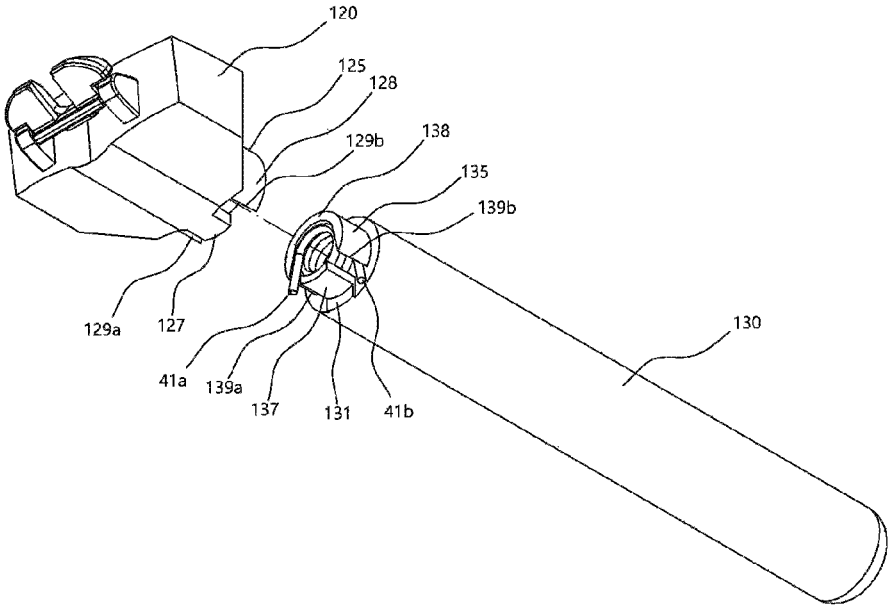
FIG. 9A is a perspective view showing a form after a torsion spring is installed at a guide member of the razor handle and right before the connecting head is assembled thereto.
Figure 9B:
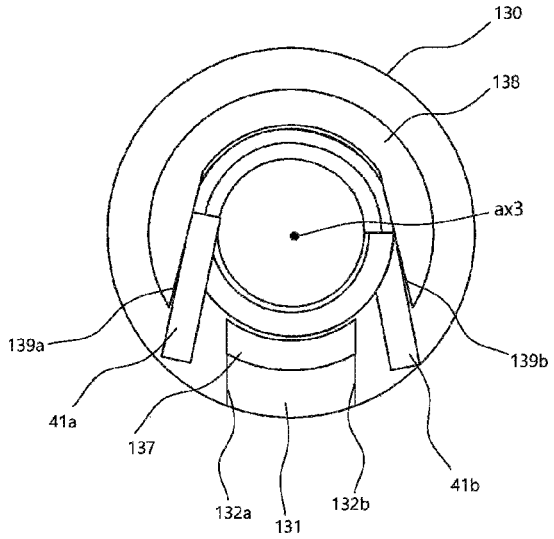
FIG. 9B is a cross-sectional view of the guide member at which the torsion spring is installed that is seen in a longitudinal direction.

FIG. 9A is a perspective view showing a form after the torsion spring 40 is installed at the guide member 135 of the razor handle 130 and before the connecting head 120 is assembled thereto, and FIG. 9B is a cross-sectional view of the guide member 135 at which the torsion spring 40 is installed that is seen in a longitudinal direction.

As illustrated, the both ends 41*a* and 41*b* of the torsion spring 40 are supported by passing through the slots 136*a* and 136*b* of the guide member 135. More specifically, the both ends 41*a* and 41*b* of the torsion spring 40 may be supported by being brought in contact with both circumferential ends 139*a* and 139*b*, respectively, of the fourth partition wall 138. Here, the one end 41*a* of the torsion spring 40 is placed at a position closer to the connecting head 120 than the other end 41*b*. In addition, it is preferable that the both ends 41*a* and 41*b* of the torsion spring 40 be in a somewhat compressed state, i.e., a pre-pressure state.

In this state, the partition walls 127 and 128 of the pivot member 125 are coupled to surround the partition walls 137 and 138 of the guide member 135. Here, preferably, both ends 129*a* and 129*b* of the second partition wall 128 of the pivot member 125 are designed to completely match the both ends 139*a* and 139*b* of the fourth partition wall 138 of the guide member 135. However, in consideration of tolerance in reality, the both ends 129*a* and 129*b* of the second partition wall 128 may be designed to be slightly larger than the both ends 139*a* and 139*b* of the fourth partition wall 138. In this case, the both ends 41*a* and 41*b* of the torsion spring 40 may be pre-pressed while being supported at the both ends 129*a* and 129*b* of the second partition wall 128.

Ultimately, in a state in which the connecting head 120 and the razor handle 130 are assembled in an axial direction, an end close to the hollow 43 of the both ends 41*a* and 41*b* of the torsion spring 40 may be supported by the both ends 139*a* and 139*b* of the fourth partition wall 138, and an end far from the hollow 43 of the both ends 41*a* and 41*b* may be supported by the both ends 129*a* and 129*b* of the second partition wall 128. In such a neutral state, when the connecting head 120 rotates counterclockwise about the third axis ax3, the other end 41*b* of the torsion spring 40 is not displaced, but the one end 41*a* thereof is displaced counterclockwise, and thus the torsion spring 40 is compressed. Likewise, when the connecting head 120 rotates clockwise, the one end 41*a* of the torsion spring 40 is not displaced, but the other end 41*b* thereof is displaced counterclockwise, and thus the torsion spring 40 is compressed. In either case, such a compressive force of the torsion spring 40 generates an opposite restoring force that causes the connecting head 120 to return to the neutral position.

Meanwhile, a stepped portion 131 is formed to extend in a radial direction from the third partition wall 137 of the guide member 135. Therefore, when the connecting head 120 pivots about the third axis ax3, the pivoting of the both ends 129*a* and 129*b* of the second partition wall 128 is restricted by both side surfaces 131*a* and 132*b* of the stepped portion 131. That is, the both side surfaces 131*a* and 132*b* of the stepped portion 131 serves as stoppers with respect to the connecting head 120. Due to the presence of the stepped portion 131, the height of the first partition wall 127 of the pivot member 125 is designed to be lower than the height of the second partition wall 128 by the height of the stepped portion 131.

The razor assemblies 100 and 200 which use the torsion spring 40 and provide a restoring force when the connecting heads 20 and 120 pivot about the second axis ax2 or the third axis ax3 have been described above in the first and second embodiments. Hereinafter, a razor assembly 300 which uses a coil spring 60 instead of the torsion spring 40 and provides a restoring force when a connecting head 220 pivots about the second axis ax2 will be described in a third embodiment.

Figure 10:
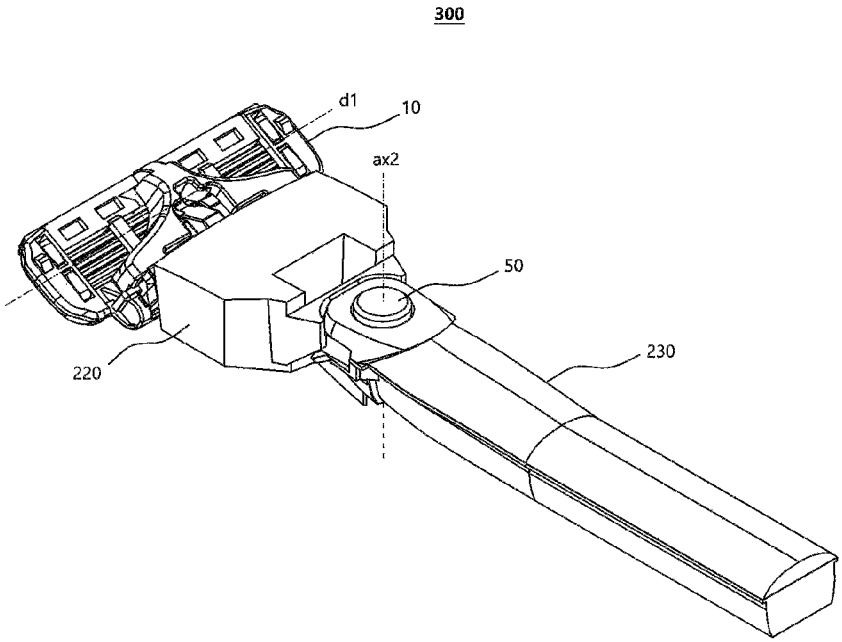
FIG. 10 is a perspective view of a razor assembly according to a third embodiment of the present disclosure that is seen from the rear.

FIG. 10 is a perspective view of the razor assembly 300 according to the third embodiment of the present disclosure that is seen from the rear.

The razor assembly 300 according to the third embodiment of the present disclosure may include the blade housing 10, the connecting head 220, and a razor handle 230. The connecting head 220 is detachably coupled to the blade housing 10 at the rear surface of the blade housing 10. In this case, the blade housing 10 may pivot about the first axis ax1, which is parallel to the transverse direction d1 in which the razor blade is accommodated, with respect to an end of the connecting head.

Meanwhile, the connecting head 220 is also coupled with the razor handle 230 so that the connecting head 220 is pivotable about the rotation axis ax2, which is perpendicular to the transverse direction d1. The rotation axis, i.e., the second axis ax2, is formed in a direction that is perpendicular to both the transverse direction d1 and the longitudinal direction d2 of the razor handle 230. Such coupling is performed by the engaging tool 50 that passes through both the connecting head 220 and the razor handle 230 at the position of the second axis ax2. The engaging tool 50 may be implemented using a fixing pin, but is not limited thereto. The engaging tool 50 encompasses shaft-like structures that enable pivoting between the connecting head 220 and the razor handle 230.

Figure 11A:
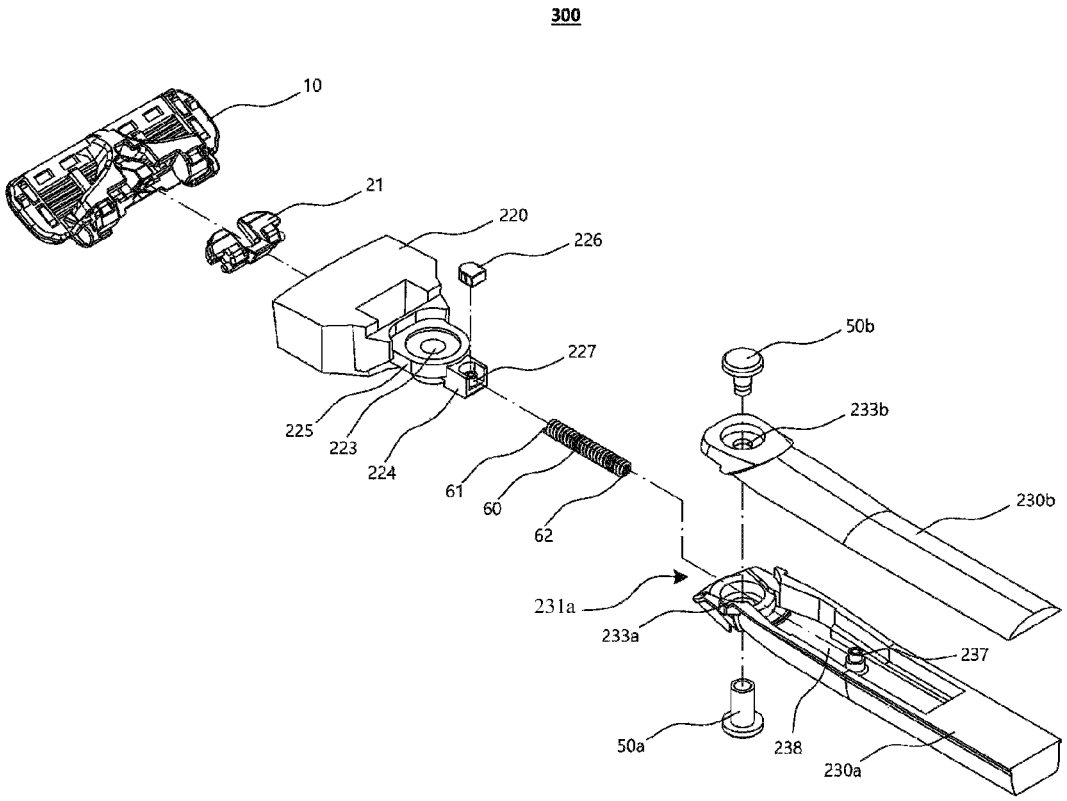
FIGS. 11A and 11B are exploded perspective views of the razor assembly of FIG. 10 seen in different directions.
Figure 11B:
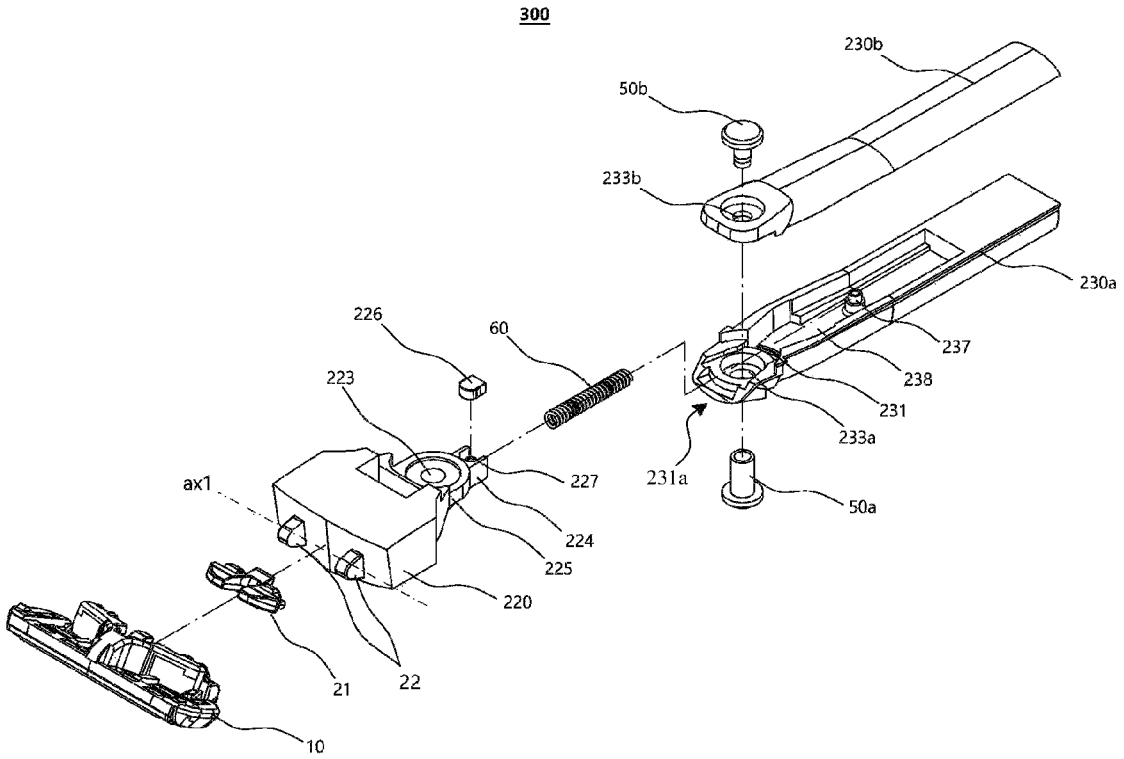

FIGS. 11A and 11B are exploded perspective views of the razor assembly 300 of FIG. 10 seen in different directions. The connecting head 220 and the razor handle 230 are fundamentally coupled using the engaging tool 50 so as to be pivotable relative to each other. In this case, in order to accommodate a pivot member 225 of the connecting head 220, the razor handle 230 may include a first accommodating member 230*a* and a second accommodating member 230*b*. After a body of the connecting head 220 is seated in an accommodating space 231*a* between the first and second accommodating members 230*a* and 230*b*, the engaging tools 50*a* and 50*b* are inserted into a through-hole 223 of the pivot member 225 and through-holes 233*a* and 233*b* of the first and second accommodating members 230*a* and 230*b* along the second axis ax2.

In addition, both ends 61 and 62 of the coil spring 60 are locked to the connecting head 220 and the razor handle 230, respectively, and provide a restoring force when the connecting head 220 pivots about the second axis ax2 with respect to the razor handle 230. In this way, when the connecting head 220 pivots about the second axis ax2 with respect to the razor handle 230, the coil spring 60 is linearly deformed to be stretched in the longitudinal direction, thereby providing the restoring force.

For accurate pivoting motion of the connecting head 220 and firm assembly between the connecting head 220 and the razor handle 230, a guide block 224 may be disposed at an end of the pivot member 225 of the connecting head 220 (at an end close to the razor handle 230). The guide block 224 includes a first fixing end 227 for causing one end 61 of the coil spring 60 to be locked thereto. Such a first fixing end 227 may be covered by a separate cover 226 after the one end 61 of the coil spring 60 is locked thereto.

In addition, an accommodating groove 238 for accommodating the coil spring is formed inside the accommodating space 231*a* of the razor handle 230, and a second fixing end 237 for causing the other end 62 of the coil spring 60 to be locked thereto is included in the accommodating groove 238. For example, the first and second fixing ends 227 and 237 may have a cylindrical shape, and the both ends 61 and 62 of the coil spring 60 which are locked to the first and second fixing ends 227 and 237 may have a circular ring shape. Therefore, when the connecting head 220 pivots with respect to the razor handle 230, interference does not occur between the both ends 61 and 62 of the coil spring 60 and the fixing ends 227 and 237.

Figure 12:
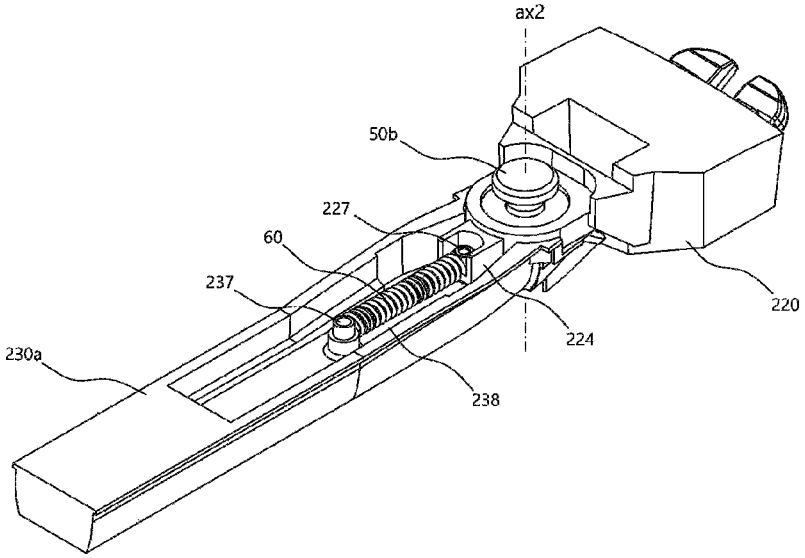
FIG. 12 is a perspective view in which a blade housing and a second accommodating member have been removed from the razor assembly of FIG. 10.

FIG. 12 is a perspective view in which the blade housing 10 and the second accommodating member 230*b* have been removed from the razor assembly 300 of FIG. 10. In this way, in a neutral state in which the connecting head 220 and the razor handle 230 are assembled, the both ends of the coil spring 60 are locked to the first fixing end 227 and the second fixing end 237, respectively, and the coil spring 60 is disposed to be parallel to the longitudinal direction of the razor handle 230. For stable operation, it is preferable that the coil spring 60 be in a pre-tension state, that is, a state in which the coil spring 60 is stretched as much as an initial value even when the connecting head 220 is at the neutral position.

Figure 13:
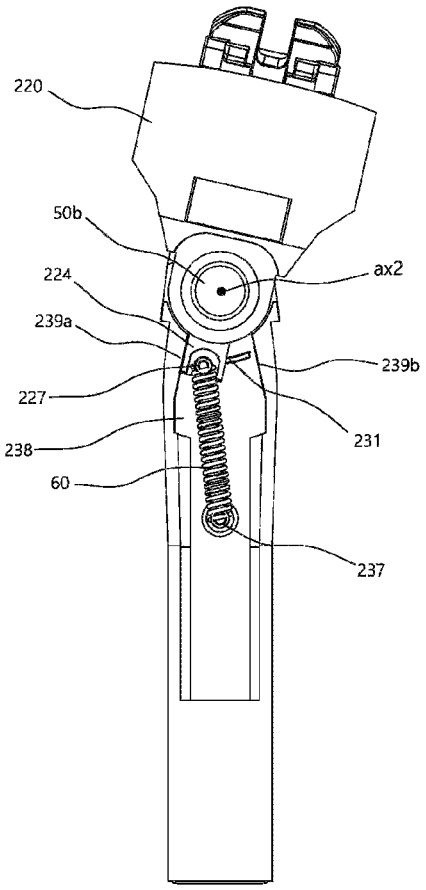
FIG. 13 is a plan view seen from the front when the razor assembly of FIG. 12 is at a pivot position.

FIG. 13 is a plan view seen from the front when the razor assembly 300 of FIG. 12 is at a pivot position. At the pivot position, in order to restrict pivoting of the connecting head 220 so that the connecting head 220 does not deviate from a limited pivoting range about the rotation axis ax2, stopper surfaces 239*a* and 239*b* that come into contact with one side of the connecting head 220 when the connecting head 220 pivots a specific angle or more are disposed in the accommodating groove 238 of the razor handle 230. In FIG. 13, the stopper surfaces 239*a* and 239*b* are illustrated as two inner surfaces in the accommodating groove 238 with which both side surfaces of the guide block 224 come into contact at the pivot position, but embodiments are not limited thereto, and the stopper surfaces 239*a* and 239*b* may also have other configurations that restrict pivoting of the connecting head 220 to be within a predetermined range.

In addition, a contact protrusion 231 which protrudes to a predetermined height from an inner surface of the accommodating groove 238 of the razor handle 230 may be formed. When the connecting head 220 pivots with respect to the razor handle 230, the contact protrusion 231 comes into contact with the guide block 224, thereby preventing the guide block 224 from directly rubbing against the inner surface of the accommodating groove 238.

Figure 14:
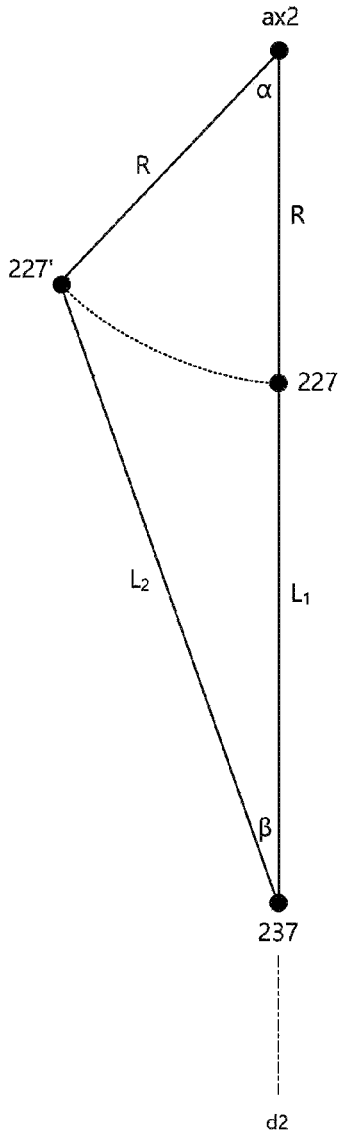
FIG. 14 is a schematic view showing the positional relationship of a second axis, a first fixing end, and a second fixing end at a neutral position and the pivot position.

FIG. 14 is a schematic view showing the positional relationship of the second axis ax2, the first fixing end 227, and the second fixing end 237 at the neutral position and the pivot position. At the neutral position, the rotation axis ax2, the first fixing end 227, and the second fixing end 237 are disposed in a row in the longitudinal direction d2 of the razor handle 230, and the rotation axis ax2 is disposed closer to the blade housing 10 than the first and second fixing ends 227 and 237. In this case, the length of the coil spring 60 before deformation is $L_1$.

At the pivot position, the first fixing end 227 moves to a position marked "227'" while keeping a distance R from the rotation axis ax2. Accordingly, the coil spring 60 is stretched from $L_1$ to $L_2$. A stretching displacement ($L_2-L_1$) of the coil spring 60 and an elastic coefficient k of the coil spring 60 are factors that determine a restoring force of the connecting head 220. Ultimately, when an angle $\alpha$ at which the first fixing end 227 pivots about the rotation axis ax2 at the pivot position is assumed, a restoring force to be designed may be determined according thereto.

The following Equation 1 and Equation 2 are satisfied by the geometrical relationship illustrated in FIG. 14.

$$R\cos(\alpha)+L_2\cos(\beta)=R+L_1 \quad \text{[Equation 1]}$$

$$(R+L_1)^2=R^2+L_2^2+2RL_2\cos(\alpha+\beta) \quad \text{[Equation 2]}$$

Here, when Equation 2 is expanded to an equation for obtaining $L_2$, the following Equation 3 may be obtained.

$$L_2=\sqrt{R^2\cos^2(\alpha+\beta)+L_1^2+2RL_1}-R\cos(\alpha+\beta)$$

When Equation 1 is applied to Equation 3, ultimately, $L_2$ is calculated as a function of $\alpha$, R, and $L_1$. In this case, a restoring force F to be designed is as the following Equation 4. Here, k is an elastic coefficient of the coil spring 60.

$$F=k(L_2-L_1) \quad \text{[Equation 4]}$$

When Equations 3 and 4 obtained as above are used, by adjusting at least one of a pivoting angle $\alpha$, a pivoting radius R of the connecting head 220, the length $L_1$ of the coil spring 60 in the neutral state, and the elastic coefficient k of the coil spring, the restoring force F having a desired magnitude may be designed.

According to the razor assembly according to the present disclosure, there is an advantage in that a pivoting movement about a rotation axis which is perpendicular to an axis which is parallel to a direction in which razor blades are aligned can be surely and stably provided.

In addition, according to the razor assembly according to the present disclosure, there is an advantage in that, since the pivoting movement about the rotation axis is implemented by extensional deformation or torsional deformation of an elastic member itself, the razor assembly is structurally simple and is less likely to be deformed even after being used for a long period of time.

In addition, according to the razor assembly according to the present disclosure, since razor blades are smoothly adhered to a profile of a user's skin, shaving performance can be improved.

Embodiments of the present disclosure have been described above with reference to the accompanying drawings, but those of ordinary skill in the art to which the present disclosure pertains should understand that the present disclosure may be practiced in other specific forms without changing the technical idea or essential features thereof. Therefore, the embodiments described above are illustrative in all aspects and should not be understood as limiting.

What is claimed is:

1. A razor assembly comprising:

at least one razor blade having a cutting edge;

a blade housing configured to accommodate the at least one razor blade aligned along a first direction;

a connecting head configured to be detachably coupled to the blade housing;

a razor handle configured to support the connecting head so that the connecting head is pivotable about a rotation axis which is perpendicular to the first direction;

a pivot member formed in the connecting head; and a torsion spring configured to be elastically deformed when the connecting head pivots about the rotation axis from a neutral position so that the torsion spring provides a restoring force for the connecting head to return to the neutral position, wherein the torsion spring is helically wound and includes a first end and a second end pointing toward different directions, wherein the first end is disposed below the pivot member and the second end is disposed above the pivot member along a direction of the rotation axis, wherein the rotation axis is perpendicular to both the first direction and a second direction in which the razor handle longitudinally extends, and wherein a central axis of the torsion spring coincides with the rotation axis.

2. The razor assembly of claim 1, wherein the pivot member and the torsion spring are accommodated in an accommodating space formed in the razor handle.

3. The razor assembly of claim 2, further comprising an engaging tool that passes through a through-hole formed in the pivot member, a hollow of the torsion spring, and at least one through-hole formed in the vicinity of the accommodating space of the razor handle at a position of the rotation axis.

4. The razor assembly of claim 3, wherein the first and second ends are configured to contact two corresponding sidewalls formed in the connecting head.

5. The razor assembly of claim 4, wherein the first and second ends of the torsion spring are disposed at opposite sides from each other with respect to the through-hole formed in the pivot member.

6. The razor assembly of claim 5, wherein, when the connecting head is at the neutral position, each of the first and second ends of the torsion spring is disposed between a corresponding sidewall of the two sidewalls formed in the connecting head and a corresponding support wall of two support walls forming a portion of the accommodating space.

7. The razor assembly of claim 6, wherein, when the connecting head pivots with respect to the razor handle, the first end of the torsion spring rotates toward the second end of the torsion spring and is displaced by the corresponding sidewall formed in the connecting head such that the torsion spring is elastically deformed.

8. The razor assembly of claim 1, further comprising a guide block formed at one side of the connecting head on the pivot member and having a shape corresponding to a guider formed at one side of the razor handle, wherein the guide block and guider are configured to guide pivoting of the connecting head.

9. The razor assembly of claim 8, further comprising a stopper surface formed in the razor handle and configured to limit movement of the guide block to define a pivoting range of the connecting head in a first rotating direction.

10. The razor assembly of claim 1, further comprising an engaging tool that passes through the connecting head, the torsion spring, and the razor handle, wherein the engaging tool comprises a first engaging tool and a second engaging tool that are coupled to each other.

11. The razor assembly of claim 10, wherein:

a first end of the first engaging tool is exposed at one side of the razor handle; and a first end of the second engaging tool is exposed at another side of the razor handle.

12. The razor assembly of claim 11, wherein the first engaging tool and the second engaging tool are coupled via a second end of the first engaging tool and a second end of the second engaging tool.

13. The razor assembly of claim 1, wherein the torsion spring is mounted on a through-hole of the pivot member.

* * * * *